United States Patent [19]

Schwarzkopf

[11] 4,165,695

[45] Aug. 28, 1979

[54] AMUSEMENT RIDE WITH VERTICAL TRACK LOOP

[75] Inventor: Anton Schwarzkopf, Münsterhausen, Fed. Rep. of Germany

[73] Assignee: Firma Anton Schwarzkopf Stahl- und Fahrzeugbau, Münsterhausen, Fed. Rep. of Germany

[21] Appl. No.: 871,992

[22] Filed: Jan. 24, 1978

[30] Foreign Application Priority Data

Jan. 31, 1977 [DE] Fed. Rep. of Germany ..... 2703833

[51] Int. Cl.[2] ..... A63G 21/10; A63G 21/04

[52] U.S. Cl. ..... 104/55; 104/162

[58] Field of Search ..... 104/53, 55, 56, 57, 104/63, 64, 65, 66, 147 R, 162; 46/209, 212, 216; 223/86 R, 86 B, 86 C

[56] References Cited

U.S. PATENT DOCUMENTS

| | | | |
|---|---|---|---|
| 750,246 | 1/1904 | Beecher | 104/55 |
| 1,405,213 | 1/1922 | Hingenitz | 104/55 |
| 1,441,404 | 1/1923 | Czerny | 104/55 |
| 2,567,438 | 9/1951 | McBride | 104/55 |
| 2,642,005 | 6/1953 | Cooper | 104/63 |
| 3,548,534 | 12/1970 | Beny et al. | 104/162 X |
| 3,735,923 | 5/1973 | Brigham et al. | 104/55 X |

*Primary Examiner*—Francis S. Husar
*Assistant Examiner*—Randolph A. Reese
*Attorney, Agent, or Firm*—Karl F. Ross

[57] ABSTRACT

A roller-coaster track includes a vertical loop and terminates in two steep rises, with a loading and unloading station disposed along a horizontal stretch of track between the loop and the lower of the two rises. An endless belt underneath that horizontal stretch entrains a carriage which, when moving along an upper run of that belt, accelerates a passenger train at the station from standstill to a velocity sufficient to let that train pass through the loop in one direction, ascend the higher rise, descend that rise and pass once more through the loop in the opposite direction before ascending and descending the lower rise, eventually coming to rest at the station. The accelerating force is derived, at the start of the ride, from stored potential or kinetic energy such as that of a weight dropping inside a guide tube or a flywheel intermittently coupled with the belt.

10 Claims, 6 Drawing Figures

AMUSEMENT RIDE WITH VERTICAL TRACK LOOP

FIELD OF THE INVENTION

My present invention relates to an amusement ride of the roller-coaster type wherein a nondriven vehicle or a train of such vehicles is driven by its own momentum along a track forming a substantially level stretch and a vertical loop as well as one or more slopes.

BACKGROUND OF THE INVENTION

It is known (see, for example, French Pat. No. 909,611) to provide such a roller coaster with a U-shaped track from whose lowest point a vehicle is hoisted to the highest point whence it descends with sufficient acceleration to pass through a vertical loop near the bottom of the slope, followed by a rising slope which it ascends before returning to its starting position. Such an amusement ride is highly thrilling, yet the delay involved in hoisting the vehicle to the peak of its track reduces the available riding time in comparison with, say, a conventional figure-eight ride of the same overall cycle length.

OBJECTS OF THE INVENTION

Thus, the principal object of my invention is to provide a roller coaster of this general type in which the ratio of actual riding time (involving only inertial and gravitational forces) to overall cycle length is considerably increased in comparison with conventional systems.

Another object is to provide an amusement ride of this character in which the track area required for a ride of given duration is greatly reduced.

SUMMARY OF THE INVENTION

A roller coaster according to my invention, including a track with a substantially level stretch followed by a vertical loop and a steep incline, comprises a station at that stretch provided with brake means for arresting an oncoming vehicle in a predetermined position. The station is equipped with external drive means engageable with the arrested vehicle for accelerating same along the track to a speed sufficient to traverse the loop in one direction, ascend the incline to a predetermined level, descend the incline and traverse the loop in the opposite direction before being again arrested at the station.

Pursuant to another feature of my invention, the track has a secondary rise or slope at an end opposite the aforementioned incline or primary slope, the speed inparted to the vehicle by the drive means (and therefore the elevation of the highest point reached on the primary slope) being sufficient to let the vehicle ascend the secondary rise after a reverse passage through the substantially level intermediate stretch; in that case the brake means at the station are ineffectual during a first traverse, i.e. upon the descent from the primary slope, so that the vehicle is arrested only after returning from the secondary slope in its original direction of travel.

In principle, the vehicle may be launched by any reciprocating drive means or linear motor such as, for example, a fluid-operated piston. I prefer, however, to accelerate the vehicle at the start of the ride with the aid of an endless conveyor disposed beneath the track, the conveyor carrying a thrust member which may be a carriage guided by a rail paralleling at least an upper run of the conveyor and which entrains the vehicle at a progressively increasing speed while moving along this upper run. The driving force for the conveyor and its thrust member is advantageously derived from a source of stored potential or kinetic energy intermittently connectable with the conveyor, such as a suspended weight or a flywheel. In either case, the stored energy lost during acceleration of the vehicle from standstill to its top speed is replenished by suitable regenerating means effective while the source is decoupled from the conveyor.

BRIEF DESCRIPTION OF THE DRAWING

The above and other features of my invention will now be described in detail with reference to the accompanying drawing in which.

SPECIFIC DESCRIPTION

Figure 1:
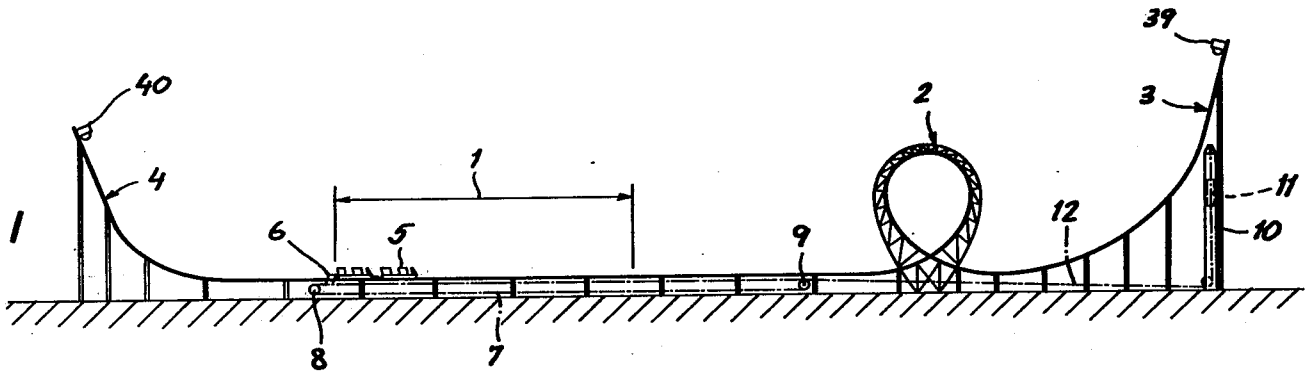
FIG. 1 is a somewhat diagrammatic side-elevational view of the overall layout of a track for a roller coaster according to my invention, including a train shown halted at a loading and unloading station.

In FIG. 1 I have shown a roller coaster comprising a track, formed by a pair of rails 25 (see FIGS. 2 and 4–6), which has a level stretch 1, an adjoining vertical loop 2, a primary incline 3 with a steep slope at one end, and a secondary rise 4 of somewhat lesser slope and reduced height at the opposite end. A vehicular train 5 is shown standing at a station provided with loading and unloading platforms 35, 36 seen in FIGS. 5 and 6.

Figure 4:
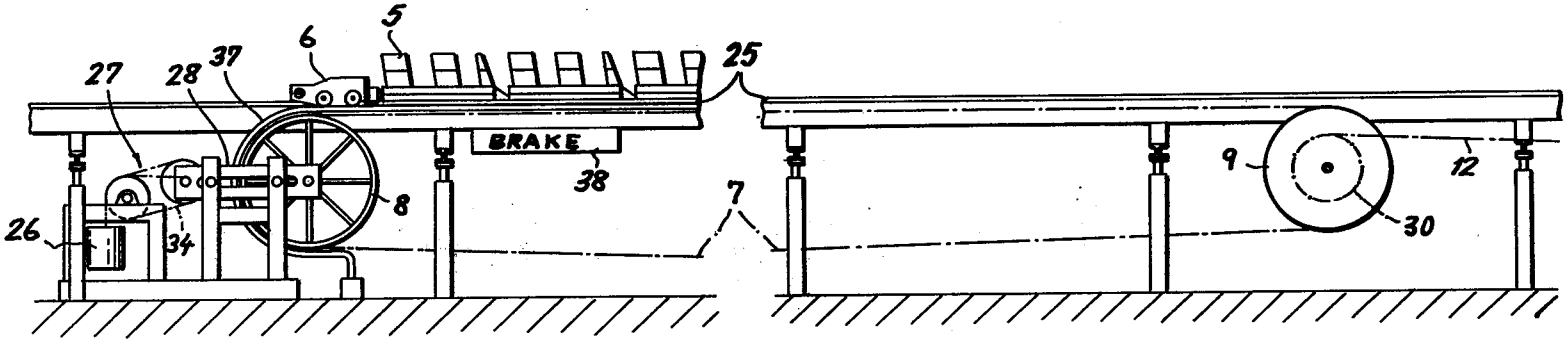
FIG. 4 is an enlarged view, drawn to a larger scale, of a portion of the track of FIG. 1 including its loading and unloading station.

A thrust member 6, in the form of a carriage more fully illustrated in FIG. 4, is positively connected with an endless conveyor belt 7 which is wound upon a pair of pulleys 8 and 9 mounted on horizontal shafts, the upper run of belt 7 lying just below the rails 25 along a section of track including the stretch 1. Belt 7 may be a simple cable, as shown in FIG. 6, but could also be a chain, with the wheels 8,9 designed as sprockets rather than pulleys.

Figure 6:
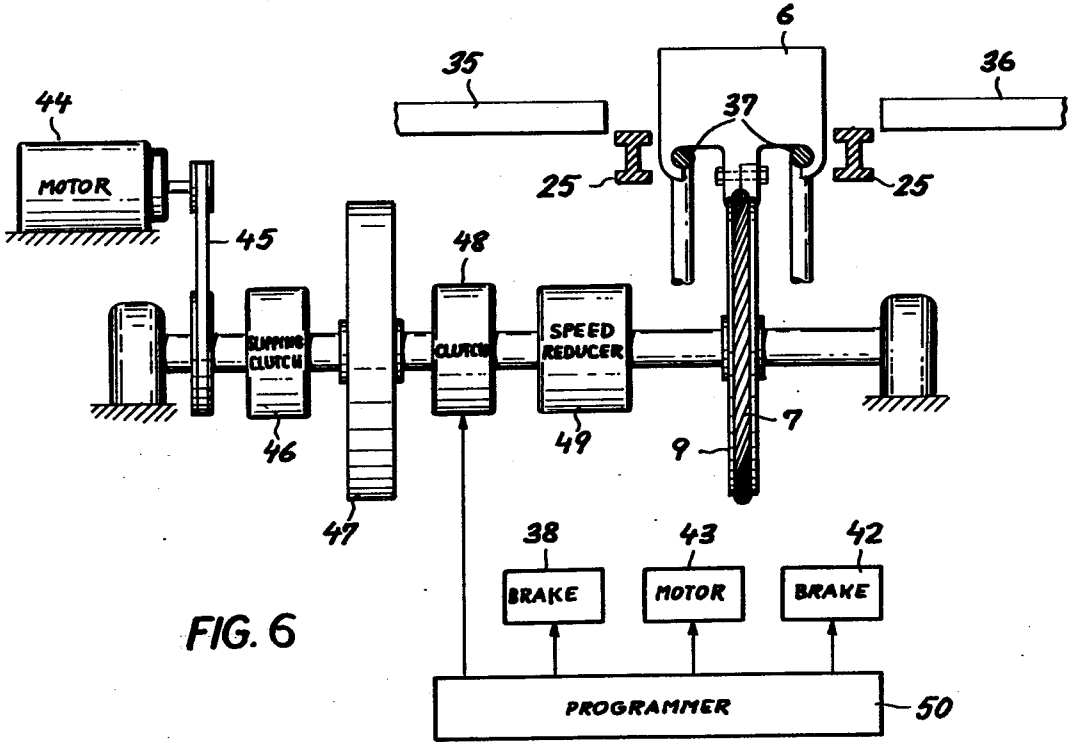
FIG. 6 is a somewhat diagrammatic cross-sectional view, also drawn to a larger scale, of the track and associated equipment according to another embodiment.

Carriage 6 is supported by guide rails 37 which in FIG. 4 extend around the back wheel 8 and along part of the upper conveyor run; in the system of FIG. 6 these guide rails parallel the entire belt 7. Upon acceleration of the normally stationary belt in a manner described hereinafter, after positioning of the carriage just behind train 5 as shown in FIGS. 1 and 4, the train is quickly brought up to a high speed carrying it through the loop 2 and up the slope 3 to a predetermined altitude somewhat below its peak whereupon gravity reverses the direction of motion and propels the train once more through the loop 2 past stretch 1 and up the slope 4 to another predetermined inversion point. The train then descends to station 35, 36 where it is arrested by a conventional brake mechanism, schematically illustrated at 38 in FIG. 4, preparatorily to the start of a new cycle.

As a safety measure, slopes 3 and 4 may be provided at their peaks with respective bumpers 39 and 40 to prevent any accidental overshooting in the case of a lightly loaded train, for example.

Figure 2:
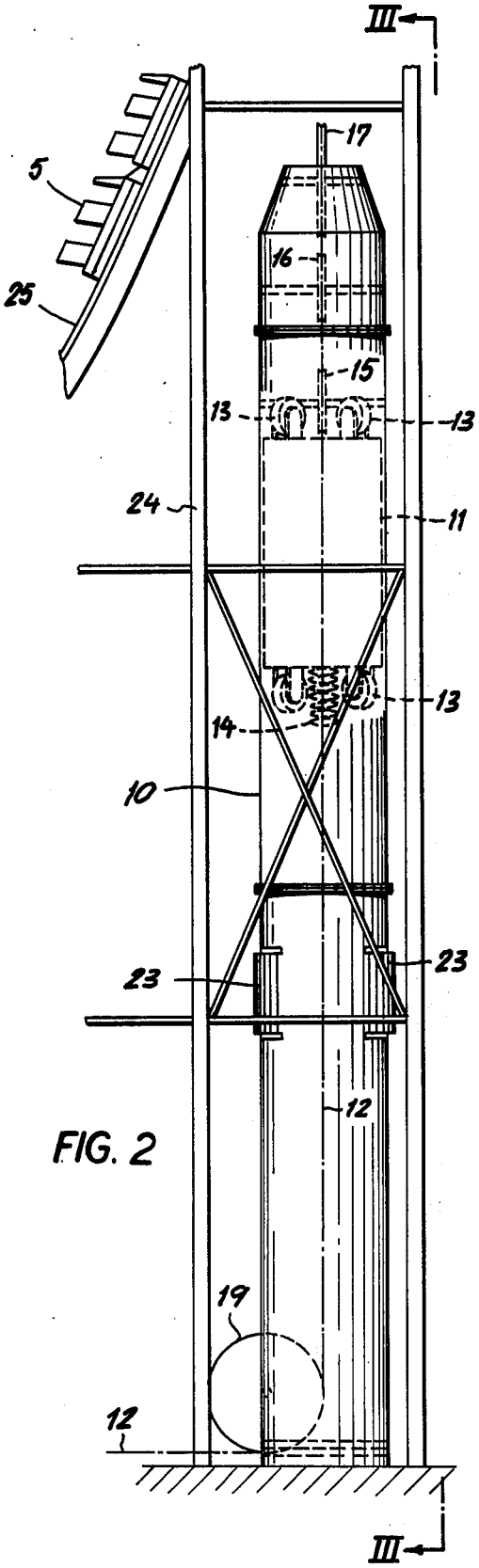
FIG. 2 is a side-elevational view, drawn to a larger scale, of a terminal part of the track shown in FIG. 1 together with a guide tower for a suspended weight serving as a source of stored potential energy.
Figure 3:
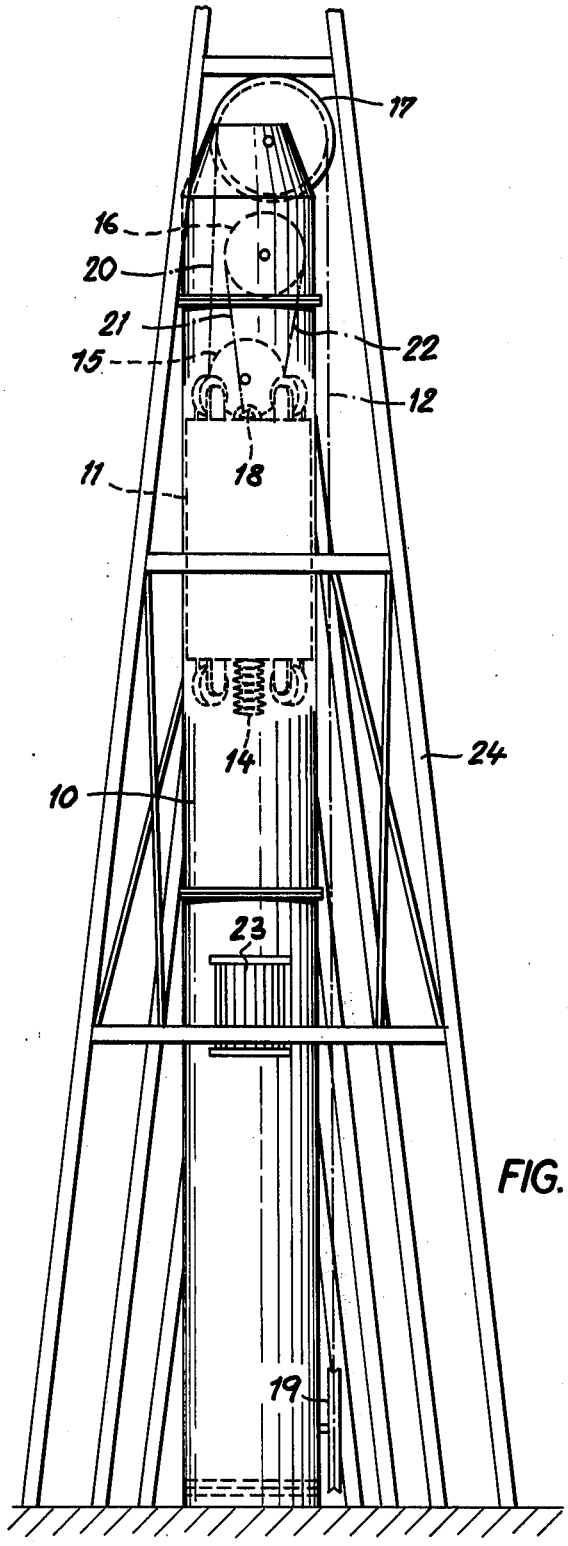
FIG. 3 is an end view of the assembly of FIG. 2, as seen on the line III—III thereof.

There are several ways in which the conveyor 7 with its carriage 6 can be set in motion to accelerate the train 5 at the beginning of each ride. The storage of potential or kinetic drive energy enables the high-rate expenditure of energy in the acceleration phase to be compensated at low power during the remainder of a cycle. In FIGS. 1–3 I have shown a store of potential energy in the form of a tower 10 serving to control the drop of a suspended weight 11. Tower 10 is conveniently accommodated in a mound which forms part of a framework 24 supporting the track 25. Rollers 13 on the body of weight 11 engage the inner surface of the tower wall which is shown provided with air passages 23 below the level of the weight elevated into its starting position. Weight 11 is suspended by a cable 12 led around a deflecting roller 19 at the foot of the tower and around a tackle which comprises an idler pulley 15, anchored to the top of the weight body, and two further idler pulleys 16 and 17 with shafts fixedly journaled in the tower wall. Cable 12, with one end secured at 18 to the weight 11, forms three passes 20, 21 and 22 supporting the weight 11 on pulleys 16 and 17; thus, each pass carries only one-third of the weight whose speed of descent is tripled upon being communicated to the main portion of cable 12 whose opposite end is fastened to a capstan 30 on the shaft of pulley 9. As the weight begins to drop, the air present in the lower part of tower 10 is compressed and escapes in part through the apertures 23, making a whistling noise which may be utilized to attract the attention of potential customers. As soon as the lower edge of weight 11 passes the apertures 23, the noise stops and the air in the substantially fluidtight lower part of the tower cushions the descent of the weight. As an additional safety measure, bumpers 14 are shown provided at the bottom of the weight body.

A brake 31 coacts with capstan 30 to keep the cable 12 in tension by preventing an overrun when the weight is decelerated. A clutch 32, open during the starting phase when the weight is being dropped, serves to connect a pair of hoist motors 33 with the capstan 30 and front pulley 9 after the train 5 has been launched, causing reverse rotation of the pulley shaft. This results in a re-elevation of the weight 11 and in a leftward movement of carriage 6 beyond the starting position shown in FIG. 4 to a level beneath the track so as to avoid any interference with the double traverse of the station by the train before it is arrested by the brake 38. Another brake 42, connected with the shaft of pulley 8, is then operated (with simultaneous release of clutch 32) to immobilize the belt until the train has come to a halt at the station. Upon the subsequent release of brake 42, a retarder 29 coupled with pulley 8 via a reducing gear 41 allows the weight 11 to descend slightly and to bring the carriage 6 at low speed into contact with the train's rear, followed by reoperation of brake 42. After the passengers have taken their seats, the simultaneous release of brakes 38 and 42 starts the next ride as the weight 11 begins to drop inside tower 10.

Figure 5:
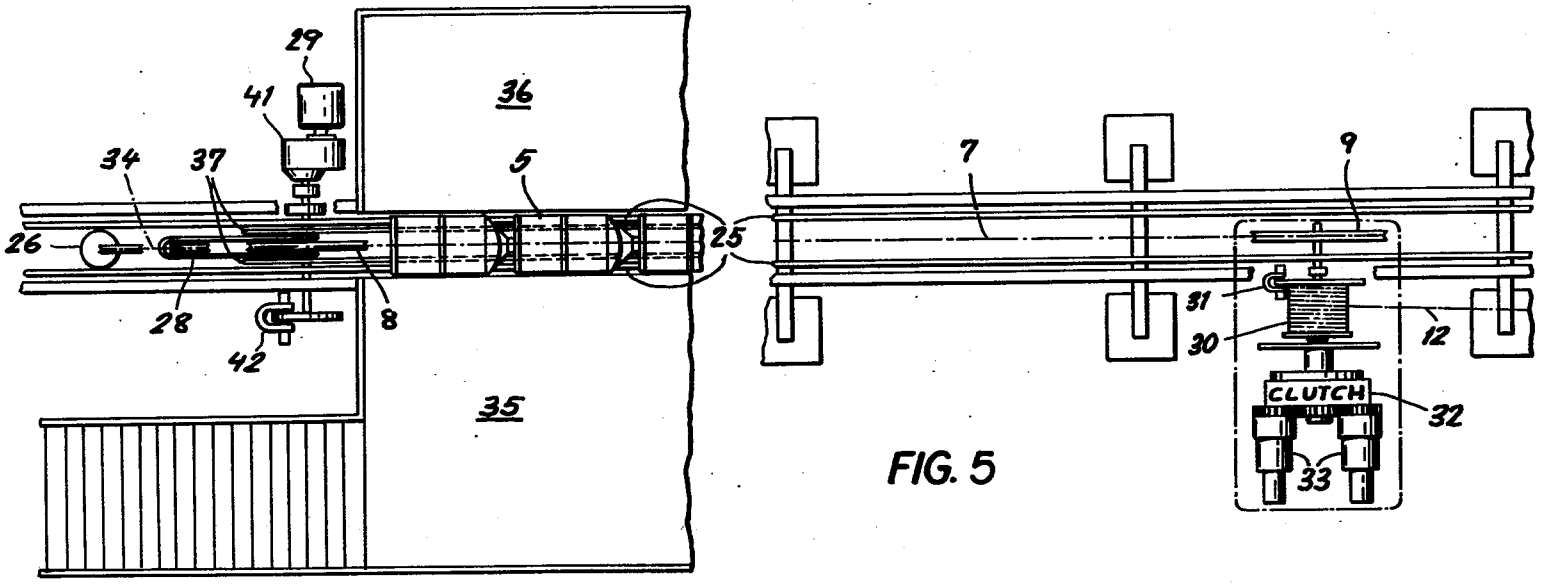
FIG. 5 is a top plan view of the track portion shown in FIG. 4.

Also shown in FIGS. 4 and 5 is a mechanism for keeping the belt 7 tensioned, this mechanism including a weight 26 on a cable 34 which is led around tackle 27 anchored to a fork 28 which carries the shaft of pulley 8.

In a practical embodiment, the length of the drop of weight 11 required for accelerating the train 5 may be 8.5 meters, the weight being then retarded over a distance of about 2 m before ending its drop approximately 3 m above the bottom of tower 10. The weight 11 is preferably in excess of 40,000 Kp (i.e. Kg-force). The slope 3 may be inclined to the horizontal at an angle of about 70°. The loop 2 may be designed in its upper part as a semicircle with a radius of about 7 m, flattening out into a pair of cornu spirals which merge into the adjoining track sections to insure a smooth transition without any bunching of the passengers. The drive motors 33 may be of the three-phase type with a power of about 50 Kw each, working through nonillustrated reduction gearing. With pulley 8 and 9 spaced about 70 m apart, the length of the entrainment path along starting stretch 1 may be about 50 m, yielding a maximum speed of about 24 m/sec with acceleration of 5.4 m/sec$^2$ or about 0.55 G. Belt 7 may be a cable about 3 cm in diameter, held under a tension of about 12,000 Kp by means of weight 26 and tackle 27. Such a system can be operated with a seven-car train seating 28 passengers; the several cars may be hingedly interconnected, preferably in accordance with the teachings of my copending application Ser. No. 772,265 filed Feb. 25, 1977, now U.S. Pat. No. 4,093,080. The overall track length may be 180 m, with slopes 3 and 4 rising to respective elevations of about 40 and 30 m.

In FIG. 6 I have illustrated a modified system in which the train is accelerated by stored kinetic energy. A motor 44 is linked via a belt drive 45 and a slipping clutch 46 with a flywheel 47 connectable by way of an electromagnetically or fluidically operated clutch 48 and a speed reducer 49 to the shaft of pulley 9. A programmer 50 controls the clutch 48 associated with front pulley 9 as well as the brake 42 and an ancillary motor 43 both coupled with the rear pulley 8 (not shown in FIG. 6). Programmer 50 can, of course, also be used with the weight-operated system of FIGS. 1–5.

With the carriage 6 positioned behind train 5 (FIG. 1) at the start of a cycle, the programmer 50 deactivates the station brake 38 and activates the clutch 48 to couple the continuously rotating flywheel 47 with pulley 9 whereby carriage 6 and train 5 are accelerated in the manner described above. Clutch 46 slips as flywheel 47 loses speed during this operation. Next, clutch 48 is deactivated and conveyor 7–9 continues to run by inertia until it is stopped by operation of brake 42 with the carriage 6 still spaced from its starting position. When the train 5 has been arrested at the station, brake 42 is released and motor 43 is briefly energized to re-establish the launching position illustrated in FIG. 4. By this time, the continuously operating main drive motor 44 has restored the flywheel 47 to its normal rotary speed which may be determined by a tachometer (not shown) included in the motor circuit.

Motor 44 may be of d-c type with a power ratio of 260 Kw and a speed of 2900 rpm which, with a step-down ration of 2.77:1 for transmission 45, results in a maximum flywheel speed of about 1044 rpm (taking into account a residual slippage of clutch 46). Speed reducer 49, which can be a planetary-gear train, may have a step-down ratio of 4:1 which, with a pulley diameter of about 2:1 m, leads to a theoretical maximum belt speed of 28.7 m/sec. The desired top speed of 24 m/sec is imparted to the train in about 4.5 seconds, with the flywheel speed dropping to 872 rpm. A nonillustrated speed sensor may release the clutch 48 at this point, independently of programmer 50, yet even without such sensor the top speed of train 5 is limited to about 26.5 m/sec with zero slip of clutch 48 when the speed of flywheel 47 drops to 964 rpm. In this latter instance the train may stop its ascent of slope at a distance of about 1.5 m from bumper 39, compared with a normal distance of 8 m, and on the return trip may stop on slope 4 about 1 m below bumper 40 instead of the normal 6 m.

With its normal top speed of 24 m/sec, the first car of train 5 will be held against the track at the vertex of loop 2 on the forward run with a pressure of about 2.3 G. On the return run, despite frictional energy losses, a track-holding pressure of 0.7 G will still be available; the stretch 1 is then traversed at about 19 m/sec.

The system according to my invention may be provided with various safety devices known per se, such as a switch at the end of stretch 1 which trips a train brake if the predetermined top speed (e.g. of 24 m/sec) has not been reached at a distance of, say, 55 m from the starting point, thereby preventing the train from traversing the loop 2 at a lesser speed. The track may also be equipped with an emergency cable winch for pulling the train, emptied of its passengers, to the top of slope 3 if the train has been arrested for some unforeseen reason between that slope and the loop; upon its disengagement from the winch, the train then rolls back through the loop to the station where it is stopped by the brake 38.

The carriage 6 need not come into direct contact with the train 5, as illustrated, but could be provided with a normally retracted coupler engaging the train only upon being extended against the force of a restoring spring with the aid of a solenoid, for example, operated just before each launch. In that case the presence of the carriage on the upper run of belt 7 will not be an obstacle to the passage of the train through the station in either direction.

A complete ride as described above may last for about 37 seconds. If the secondary rise 4 is omitted and the train is halted upon its return to the station from loop 2, that time is shortened to 31 seconds. With a loading and unloading period of 34 seconds allowed, the length of a cycle would be 71 seconds for the complete ride and 65 seconds for the abbreviated one. This corresponds to a capacity of 1420 passengers per hour in the first instance and 1550 passengers per hour in the second instance.

I claim:

1. A roller coaster comprising:

a track having a substantially level stretch followed by a vertical loop and a steep incline;

a nondriven vehicle movable on said track;

a station at said stretch provided with brake means for arresting said vehicle in a predetermined position; and external drive means at said stretch engageable with the arrested vehicle for accelerating same to a speed sufficient to traverse said loop in one direction, ascend said incline to a predetermined level, descend said incline and traverse said loop in the opposite direction before being again arrested at said station.

2. A roller coaster as defined in claim 1 wherein said track is provided with a secondary rise at an end opposite said incline, the speed imparted to said vehicle by said drive means being sufficient to let said vehicle ascend said secondary rise after a passage through said stretch in said opposite direction, said brake means being operable to arrest said vehicle upon an approach of said station in said one direction after a descent from said secondary rise.

3. A roller coaster as defined in claim 1 wherein said drive means comprises an endless conveyor disposed beneath said track along part of said stretch and a thrust member on said conveyor engageable with said vehicle.

4. A roller coaster as defined in claim 3 wherein said conveyor has an upper run close to said track and a lower run remote from said track, said thrust member being engageable with said vehicle while moving along said upper run.

5. A roller coaster as defined in claim 4 wherein said thrust member comprises a carriage provided with a guide rail paralleling said upper run.

6. A roller coaster as defined in claim 3 wherein said drive means further comprises a source of stored energy intermittently connectable with said conveyor and regenerating means for successively replenishing said stored energy.

7. A roller coaster as defined in claim 6 wherein said source comprises a suspended weight droppable from an elevated level and transmission means coupling said weight with said conveyor for translating a drop of said weight from said elevated level into a rotation of said conveyor, said regenerating means comprising a hoist motor connectable with said transmission means for raising said weight to said elevated level.

8. A roller coaster as defined in claim 7 wherein said transmission means includes a capstan, a cable leading from said capstan to said weight, and a tackle guiding said cable for lengthening the effective stroke of said weight.

9. A roller coaster as defined in claim 8 wherein said incline is formed by a mound rising above the level of said stretch, further comprising a tower within said mound forming a guide for said weight, said tackle being disposed in said tower.

10. A roller coaster as defined in claim 6 wherein said source comprises a flywheel and coupling means operable to establish a driving connection between said flywheel and said conveyor, said regenerating means comprising a drive motor intermittently connectable with said flywheel for accelerating same.

* * * * *